United States Patent [19]

Titolo

[11] Patent Number: 4,570,581

[45] Date of Patent: Feb. 18, 1986

[54] DEVICE FOR REGULATING THE AXIAL POSITION OF A VARIABLE-PROFILE CAMSHAFT, IN PARTICULAR, FOR CONTROLLING THE TIMING SYSTEM ON AN ENGINE

[75] Inventor: Andrea Titolo, Turin, Italy

[73] Assignee: Fiat Auto S.p.A., Turin, Italy

[21] Appl. No.: 573,873

[22] Filed: Jan. 25, 1984

[30] Foreign Application Priority Data

Feb. 4, 1983 [IT] Italy ..... 67126 A/83

[51] Int. Cl.[4] ..... F01L 1/34

[52] U.S. Cl. ..... 123/90.18; 123/90.17

[58] Field of Search ..... 123/90.17, 90.18; 137/45

[56] References Cited

U.S. PATENT DOCUMENTS

| | | | |
|---|---|---|---|
| 3,481,314 | 12/1969 | Le Crenn | 123/90.18 |
| 3,638,624 | 2/1972 | O'Grady | 123/90.18 |
| 3,730,150 | 5/1973 | Codner, Jr. | 123/90.18 |
| 4,316,437 | 2/1982 | Bertrand | 123/90.18 |
| 4,399,784 | 8/1983 | Foley | 123/90.18 X |

*Primary Examiner*—William R. Cline
*Assistant Examiner*—Peggy A. Neils
*Attorney, Agent, or Firm*—Michael N. Meller

[57] ABSTRACT

Regulating device with a hydraulic piston sliding inside a chamber and connected integral with a variable-profile camshaft on the side subjected to the axial strain exchanged between the shaft and respective tappets; the device also being provided with a bush and grooved recess arrangement for connecting the chamber selectively to a pressure fluid supply duct or drain duct, and a centrifugal regulator fitted on to the camshaft for controlling the movement of the bush in the recess.

5 Claims, 1 Drawing Figure

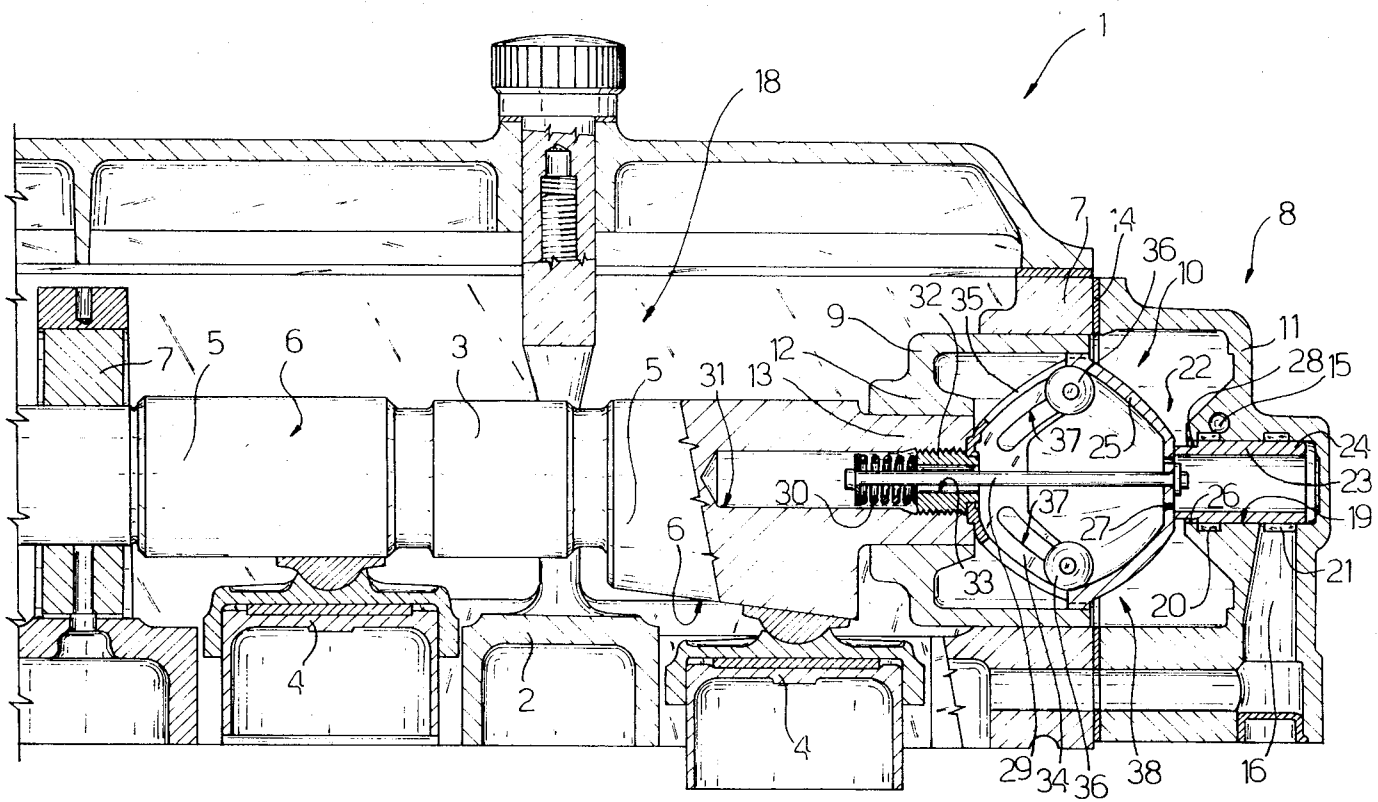
1
2
3
4
5
6
7
8
9
10
11
12
13
14
15
16
18
19
20
21
22
23
24
25
26
27
28
29
30
31
32
33
34
35
36
37
38

DEVICE FOR REGULATING THE AXIAL POSITION OF A VARIABLE-PROFILE CAMSHAFT, IN PARTICULAR, FOR CONTROLLING THE TIMING SYSTEM ON AN ENGINE

BACKGROUND OF THE INVENTION

The present invention relates to a device for regulating the axial position of a variable-profile camshaft, the said device moving axially along its rotation axis and being provided with cams for engaging valve tappets and having a profile varying linearly along the said axis of rotation of the camshaft. In particular, the present invention relates to a device for regulating the position of a camshaft of the said type so as to control the timing system of an internal combustion engine on a vehicle.

SUMMARY OF THE INVENTION

The aim of the present invention is to provide a device for regulating the axial position of a variable-profile camshaft of the said type which is easy and cheap to make, which provides for a high degree of reliability and operating precision and which enables the axial movement of the camshaft to be controlled directly with no servomechanisms therebetween.

With these aims in view, the present invention relates to a device for regulating the axial position of a variable-profile camshaft, the said device moving axially along its rotation axis and being provided with cams for engaging valve tappets and having a profile varying linearly along the said axis of rotation of the said camshaft, in particular for controlling the timing system on an internal combustion engine, the valve opening on the engine varying in constant proportion with the speed of the engine, characterized in that it comprises a hydraulic piston, coaxial with and axially and angularly integral with the camshaft, the said piston sliding inside a chamber with which a pressure fluid supply duct and drain duct communicate and being fitted on the end of the said camshaft subjected to the axial strain exchanged between the said cams and the said tappets; the said device also comprising first means for connecting the said chamber selectively to the said supply and drain ducts so as to regulate the pressure inside the said chamber, and second means, integral with the said end of the said camshaft, for activating the said first means so as to raise or lower the pressure in the said chamber when the rotation speed of the said camshaft increases or decreases respectively.

BRIEF DESCRIPTION OF THE DRAWING

One arrangement of the present invention will now be described, by way of a non-limiting example, with reference to the attached drawing showing a longitudinal section of the cylinder head of an internal combustion engine fitted with a variable-profile camshaft the axial position of which is regulated by a device according to the present invention.

DETAILED DESCRIPTION OF THE INVENTION

Number 1 on the above drawing indicates an internal combustion engine for a vehicle (not shown). For the sake of simplicity, of the engine the drawing only shows the cylinder head (2) fitted with an overhead camshaft (3) which engages with known types of mechanical tappets (4) of valves (not shown) for supplying and/or draining oil to and from engine 1. Camshaft 3 is of the variable-profile cam type and comprises cams 5, which are out of phase by an appropriate angle, in sliding contact with tappets 4 and having an appropriately shaped profile (6) varying linearly and parallel to the axis of rotation of shaft 3 which thus moves axially along its rotation axis, supported by bearing 7 which allows it to slide and rotate, the said bearing being of the sliding type with appropriate lubrication. A camshaft of this type is already known and widely used for controlling the timing system of an internal combustion engine, such as engine 1, by opening and closing the valve on the engine in direct proportion with engine speed so as to compensate with longer strokes for the decrease in valve opening and closing time caused by increased rotation speed of camshaft 3 the speed of which is obviously proportional to that of the drive shaft driving it. As shown on the attached drawing, by moving shaft 3 leftwards as its rotation speed increases, tappets 4 engage with larger-radius portions of profile 6 so as to increase travel on the relative valves. Vice versa, by moving shaft 3 rightwards as its rotation speed decreases, tappets 4 engage with smaller-radius portions of profile 6 so as to reduce travel on the relative valves.

According to the present invention, engine 1 is fitted with a device (8) for regulating the axial position of camshaft 3 the said device being designed to shift camshaft 3 automatically, as already described, during changes in its rotation speed. Device 8 is housed in cylinder head 2 coaxial with shaft 3 and comprises an essentially cylindrical, cup-shaped hydraulic piston (9) sliding inside a chamber (10) which is also cylindrical and coaxial with piston 9 and camshaft 3, the said chamber being defined by bearing 7 and cover 11, the latter suitably shaped and fitted on to the side of cylinder head 2. Piston 9 has a portion with a coupling (12) by which it is fitted axially and angularly integral with (i.e. forced on to) one end (13) of shaft 3, so as to act as a support for shaft 3, piston 9 itself being, in turn, supported by bearing 7 in which it is allowed to turn and slide axially. End 13, onto which, according to the present invention, piston 9 must be fitted, is the end of shaft 3 subjected to the axial strain exchanged between cam 5 and tappets 4 during rotation of shaft 3 or, rather, the end of the side where the radii of profile 6 of cams 5 are largest. Towards end 13, chamber 10 is defined by piston 9 by which it is closed together with fluid seals 14. Chamber 10 is the outlet for a pressure fluid supply duct (15) and drain duct (16) located inside cylinder head 2 and preferably connected to the lubricating circuit of engine 1 for supplying and draining oil under pressure to and from chamber 10 for operating piston 9. The latter has no seals so as to allow part of the oil under pressure in chamber 10 to leak through to another chamber (18), essentially at room pressure and housing shaft 3, so as to lubricate the sliding surfaces of bearing 7 engaging with the side wall of piston 9. In more detail, chamber 10 comprises a cylindrical recess (19), on the opposite side to piston 9 and coaxial with it, provided with annular grooves 20 and 21 with which ducts 15 and 16 communicate respectively. Inside recess 19, provision is made for a sliding hydraulic case (22) designed to slide axially, inside recess 19, into a working position which essentially provides for fluid sealing grooves 20 and 21, besides a number of other working positions for connecting grooves 21 and 20 selectively to chamber 10. Case 22 comprises a hollow cylindrical bush (23), open at bush end 24, and a fork piece (25), integral with end 26 on bush 23, opposite end 24 and housed inside chamber 10, the said fork piece extending towards and facing piston 9 into which it is designed to fit. Piece 25 essentially closes end 26 and has one or more through holes (27) for connecting the inside of bush 23 and, via this, recess 19 to the rest of chamber 10. The edges of ends 24 and 26 are designed to engage with the side wall of recess 19 so as to open and/or close respective grooves 20 and 21. End 26 has a number of axial grooves (28) designed to connect groove 20 with chamber 10 when bush 23 is moved partly or totally to the right in relation to the position shown. Fork piece 25, which is essentially U-shaped and either made in one piece with or welded to bush 23 so as to be axially integral with it, is engaged by a link (29) which connects it to a spring (30) housed inside hole 31 on end 13 and held inside it by a shoulder piece (32), preferably threaded, fitted integral with the inside of hole 31 and provided, in turn, with hole 33 to enable link 29 to be fitted through. Spring 30 is designed to push link 29 leftwards and, consequently, slide case 22 towards piston 9, so as to push fork piece 25 inside piston 9 to slide bush 23 partly out of recess 19.

Towards chamber 10, piston 9 houses a second fork piece (34) made in one piece with piston 9 or, preferably, snapped or forced onto part 32 to make it axially integral with piston 9 on end 13. Fork piece 34, which faces part 25 and is shaped the same way only larger, is provided with a center slot (35) for part 25 to slidably fit into. Inserting part 25 into part 34 enables both to be housed inside piston 9 when the latter is in the right-hand end-stroke position in relation to the position shown on the attached drawing, fully inside chamber 10. Part 34 supports connected rotary masses 36 arranged symmetrically and designed to move radially away from the axis of rotation of shaft 3, as a result of the centrifugal force created by the rotation of shaft 3 and, consequently, also of piston 9 and part 34 integral with it.

Masses 36 are housed and slide inside respective skew slots (37) on part 34, the said slots being directed obliquely, in relation to the axis of rotation of shaft 3, towards the side opposite end 13, so as to move away from the latter, and are designed to engage with part 25 so as to be pushed by the latter into slots 37, towards end 13, by spring 30 and, vice versa, so as to push case 22 rightwards against spring 30 when they move away from the axis of rotation of shaft 3 as a result of the centrifugal force being exerted. Slots 37, in fact, are designed so as to force masses 36 to move axially towards recess 19 as they themselves move away from the axis of rotation of shaft 3 and, vice versa, to move towards end 13 as they approach the said axis of rotation. Parts 25 and 34, masses 36 and spring 30 thus form a centrifugal regulator (38) fitted integral with shaft 3 and designed to activate hydraulic case 22 so as to regulate the pressure inside chamber 10. Operation of the device described is as follows. The pressure of the oil inside chamber 10 counterbalances, at all times, the axial forces caused by skew profile 6 and which tend to push shaft 3 rightwards and piston 9, connected to it, rightwards. The condition of shaft 3 is therefore one of stable equilibrium and bush 23, subjected to the opposite thrust exerted by spring 30 and masses 36, in turn, subjected to the centrifugal force exerted by the rotation of shaft 3, moves into the position shown, in which duct 16 is closed and groove 20 is almost closed so as to allow enough oil into chamber 10 to counterbalance leakage through piston 9 and to maintain the pressure in chamber 10 constant. When the rotation speed of shaft 3 increases, masses 36 are forced by spring 30 away from the axis of shaft 3 and push case 22 rightwards so as to open groove 20 completely. Oil under pressure thus flows freely into chamber 10, so as to raise the pressure inside, and pushes piston 9 and shaft 3 leftwards so as to bring tappet 4 on to a larger-radius portion of profile 6. This movement, however, also moves bush 23 leftwards so as to close groove 20 and secure shaft 3 in a new position of equilibrium further to the left in relation to the previous position. Vice versa, when the speed of shaft 3 falls, masses 36 move towards end 13 closer to the axis of shaft 3 and spring 30 moves case 22 leftwards so as to open groove 21 and close groove 20 completely. Consequently, the pressure inside chamber 10 falls because part of the oil flows down into duct 16 and shaft 3, subjected to the thrust exerted by the axial forces produced by tappets 4, moves to the right so as to push piston 9 into chamber 10 and, consequently, bush 23 moves rightwards by the same amount, which closes groove 21, and reassumes in recess 19 the position shown on the drawing which secures shaft 3 in new position of equilibrium further to the right in relation to the previous position.

The advantages of the present invention will be clear from the description given. In particular, it provides for a regulating device of simple manufacturing design and reliable operation, the transfer function or operation of which can easily be varied, without affecting the load-bearing structure of the regulator, by simple changing spring 30 with another of different elasticity and/or by changing masses 36 with others of different weight. To those skilled in the art it will be clear that changes can be made to the invention described, by way of a nonlimiting example, without, however, departing from the scope of the present invention.

What is claimed is:

1. A device for regulating the axial position of a variable-profile camshaft, which moves axially along its axis of rotation and which is provided with cams for engaging valve tappets, said cams having a profile which varies linearly along said axis of rotation for controlling the timing system on an internal combustion engine, the valve opening on the engine varying in constant proportion with the speed of the engine, said device comprising in combination:

(a) a hydraulic cylinder comprising a pressure chamber provided within the cylinder head of the engine coaxial with said camshaft, and a cup-shaped piston enclosing one side of said pressure chamber and integrally arranged on the end of said shaft which is subject to the axial strain transmitted between said cams and said tappets;

(b) a sliding pressure control valve for said pressure chamber comprising a hydraulic case housed in a recess of said pressure chamber, in which a supply duct and a drain duct communicate with said pressure chamber, whereby said pressure chamber is respectively filled with and emptied of pressurized oil; and (c) control means for controlling said pressure control valve arranged to act in response to a change in the angular speed of said camshaft, said control means in turn comprising:

(i) a first forkpiece (34) housed inside said pressure chamber and connected integrally with said end of said camshaft which is subject to the axial strain transmitted between said cams and said tappets, said first forkpiece being provided with slots, skewed in relation to the axis of translation of said piston and in which rotary masses are housed and slide, said slots being arranged to force said rotary masses to move axially towards said recess as said rotary masses move radially away from the axis of rotation of said camshaft, and to move towards said end of the camshaft which is subject to strain transmitted between said cams and said tappets as said rotary masses move radially toward said axis of rotation;

(ii) a second forkpiece (25) housed inside said pressure chamber, facing toward said first forkpiece and rigidly affixed with respect to said hydraulic case, said second forkpiece being shaped so as to cooperate with said first forkpiece and to engage said rotary masses; and (iii) a link connecting said second forkpiece to a spring housed in a bore provided in said end of the camshaft which is subject to strain transmitted between said cams and said tappets, said spring being arranged to slide said hydraulic case towards said piston so as to urge said second forkpiece into contact with said rotary masses.

2. The device according to claim 1, wherein said piston supports said camshaft and is slidably arranged in a bearing such that oil leakage occurs between said piston and said bearing and from said pressure chamber.

3. The device according to claim 1, wherein said recess is provided with first and second annular grooves which respectively communicate with said supply duct and said drain duct, said hydraulic case being arranged to slide axially in said recess and to assume first, second, and third operating positions, such that said supply duct communicates with said pressure chamber, said drain duct communicates with said pressure chamber, and said supply duct and drain duct are closed when said hydraulic case assumes said first, second, and third operating positions, respectively.

4. The device according to claim 3, wherein said hydraulic case comprises a hollow cylindrical bush, said bush having a first end which is open and has an edge arranged to engage said recess whereby said second groove is opened and closed during axial displacement of said bush, and a second end which is integrally formed with said second forkpiece and has through holes formed therein for connecting the inside of said bush to said pressure chamber, said second end being arranged to engage said recess whereby said first groove is opened and closed during axial displacement of said bush, said bush being provided with a number of axial slots arranged to connect said first groove to said pressure chamber.

5. The device according to claim 1, wherein said first forkpiece is housed inside said cup-shaped piston.

* * * * *